US011452898B2

(12) United States Patent
Corrigan et al.

(10) Patent No.: US 11,452,898 B2
(45) Date of Patent: Sep. 27, 2022

(54) RESISTANCE-GENERATING DEVICE, EXERCISE APPARATUS, AND METHOD

(71) Applicant: 1195143 B.C. LTD., Langley (CA)

(72) Inventors: Gregory Lloyd Corrigan, Vancouver (CA); Benjamin Charles Zuckerman, Vancouver (CA); Tima Fader, Surrey (CA); Yin Kwong William Tang, Western District (HK)

(73) Assignee: 1195143 B.C. LTD., White Rock (CA)

( * ) Notice: Subject to any disclaimer, the term of this patent is extended or adjusted under 35 U.S.C. 154(b) by 11 days.

(21) Appl. No.: 17/177,741

(22) Filed: Feb. 17, 2021

(65) Prior Publication Data

US 2021/0252325 A1 Aug. 19, 2021

Related U.S. Application Data

(63) Continuation of application No. 16/323,549, filed as application No. PCT/CA2017/050969 on Aug. 16, 2017, now Pat. No. 10,953,259.

(Continued)

(51) Int. Cl.

| | |
|---|---|
| ***A63B 21/04*** | (2006.01) |
| ***A63B 21/055*** | (2006.01) |
| ***A63B 21/00*** | (2006.01) |

(52) U.S. Cl.

CPC ..... *A63B 21/04* (2013.01); *A63B 21/00065* (2013.01); *A63B 21/00072* (2013.01);

(Continued)

(58) Field of Classification Search

CPC ..... A63B 21/04; A63B 21/00065; A63B 21/0557; A63B 21/0428; A63B 21/0552;

(Continued)

(56) References Cited

U.S. PATENT DOCUMENTS

| | | |
|---|---|---|
| 254,108 A | 2/1882 | Bryon |
| 679,784 A | 8/1901 | Ryan |

(Continued)

FOREIGN PATENT DOCUMENTS

| | | |
|---|---|---|
| CA | 1284666 C | 6/1991 |
| CN | 2805828 Y | 8/2006 |

(Continued)

OTHER PUBLICATIONS

Partial English translation of Office Action dated Jul. 3, 2020 in the corresponding Chinese patent application No. 2017800641695.

Written Opinion dated Aug. 13, 2019 for Singapore Patent Application No. 11201807424V.

Supplementary European Search Report, EP17840668, dated Feb. 27, 2020.

(Continued)

*Primary Examiner* — Joshua Lee

*Assistant Examiner* — Catrina A Letterman

(74) *Attorney, Agent, or Firm* — Norton Rose Fulbright Canada LLP; Maya Medeiros

(57) ABSTRACT

A resistance-generating device includes a resilient body extending between opposed ends. The resilient body has a first portion extending between first and second mounting members of the device, and a second portion extending between the first and second mounting members. The first portion is spaced apart from the second portion, and the first and second mounting members are made of an inelastic material. At least one of the first and second mounting members is removably mountable to a corresponding one of the first and second mounting members of another resistance-generating device. The resilient body generates resistance upon the first and second portions being elastically deformed by displacement of the second mounting member mounted to a second structure relative to the first mounting member mounted to a first structure.

22 Claims, 8 Drawing Sheets

Related U.S. Application Data

(60) Provisional application No. 62/375,940, filed on Aug. 17, 2016.

(52) U.S. Cl.
CPC ..... *A63B 21/0428* (2013.01); *A63B 21/055* (2013.01); *A63B 21/0552* (2013.01); *A63B 21/0557* (2013.01)

(58) Field of Classification Search
CPC . A63B 21/055; A63B 21/00072; A63B 17/00; A63B 17/04; A63B 19/00; A63B 19/02; A63B 2009/002; A63B 2009/004; A63B 2022/0079; A63B 2022/0082; A63B 2022/0084; A63B 2023/006; A63B 21/0004; A63B 21/00043; A63B 21/00058; A63B 21/00061; A63B 21/00069; A63B 21/00076; A63B 21/00178; A63B 21/00181; A63B 21/00185; A63B 21/002; A63B 21/008; A63B 21/0083; A63B 21/0084; A63B 21/0085; A63B 21/0087; A63B 21/0088; A63B 21/012; A63B 21/018; A63B 21/02; A63B 21/021; A63B 21/022; A63B 21/023; A63B 21/025; A63B 21/026; A63B 21/028; A63B 21/0407; A63B 21/0414; A63B 21/0421; A63B 21/0435; A63B 21/0442; A63B 21/045; A63B 21/0455; A63B 21/05; A63B 21/0555; A63B 21/06; A63B 21/0601; A63B 21/0602; A63B 21/0603; A63B 21/0607; A63B 21/0609; A63B 21/0615; A63B 21/062; A63B 21/0622; A63B 21/0624; A63B 21/0626; A63B 21/072; A63B 21/0722; A63B 21/0724; A63B 21/0726; A63B 21/0728; A63B 21/075; A63B 21/078; A63B 21/0783; A63B 21/08; A63B 21/15; A63B 21/151; A63B 21/152; A63B 21/153; A63B 21/158; A63B 21/16; A63B 21/1609; A63B 21/1618; A63B 21/1663; A63B 21/1672; A63B 21/1681; A63B 21/169; A63B 21/28; A63B 21/285; A63B 21/40; A63B 21/4001; A63B 21/4003; A63B 21/4005; A63B 21/4007; A63B 21/4009; A63B 21/4011; A63B 21/4013; A63B 21/4015; A63B 21/4017; A63B 21/4019; A63B 21/4021; A63B 21/4023; A63B 21/4025; A63B 21/4041; A63B 21/4043; A63B 21/4045; A63B 22/00; A63B 22/0002; A63B 22/0046; A63B 22/0076; A63B 22/0089; A63B 2209/00; A63B 2225/09; A63B 23/00; A63B 26/00; A63B 5/20; A63B 5/205; A63B 5/22; A63B 7/00; A63B 7/02; A63B 7/04; A63B 7/045; A63B 7/08; A63B 7/085
See application file for complete search history.

(56) References Cited

U.S. PATENT DOCUMENTS 1,538,844 A 5/1925 Titus
1,620,910 A * 3/1927 Minnich ..... A63B 21/0004 482/126
1,633,124 A * 6/1927 Noe ..... A63B 21/00043 482/126
1,749,544 A * 3/1930 Pagano ..... A63B 21/00043 482/126
2,930,614 A 3/1960 McIntosh
2,977,120 A 3/1961 Morris
3,427,023 A 2/1969 Silberman
3,863,521 A 2/1975 Gatsos
3,958,803 A 5/1976 Geisselbrecht
4,072,309 A 2/1978 Wilson
4,492,375 A * 1/1985 Connelly ..... A63B 21/4029 482/130
4,582,320 A * 4/1986 Shaw ..... A63B 23/03525 482/130
4,621,805 A 11/1986 Chen
4,666,151 A 5/1987 Chillier
4,685,670 A 8/1987 Zinkin
4,749,286 A * 6/1988 White ..... A63B 21/055 384/220
5,029,850 A 7/1991 Van Straaten
5,050,869 A 9/1991 Frate
5,135,216 A * 8/1992 Bingham ..... A63B 21/05 482/52
5,144,859 A 9/1992 Malone
5,242,353 A * 9/1993 Cole ..... A63B 21/04 482/130
5,334,122 A 8/1994 Cole et al.
5,387,171 A * 2/1995 Casey ..... A63B 21/1609 482/133
5,468,205 A 11/1995 McFall et al.
5,584,782 A * 12/1996 Szabo ..... A63B 22/0056 482/52
5,603,681 A 2/1997 Olschansky et al.
5,616,111 A * 4/1997 Randolph ..... A63B 21/4047 482/133
D389,205 S * 1/1998 van Straaten ..... D21/690
5,722,922 A * 3/1998 Watterson ..... A63B 23/03525 482/136
5,820,529 A 10/1998 Weintraub
5,842,939 A 12/1998 Pui
5,885,196 A 3/1999 Gvoich
6,015,371 A 1/2000 Davitt
6,042,523 A 3/2000 Graham
6,142,919 A 11/2000 Jorgensen
6,319,179 B1 11/2001 Hinds
6,494,817 B2 12/2002 Lake
6,669,609 B2 12/2003 Gerschefske et al.
6,676,576 B1 1/2004 Wu
7,041,041 B1 * 5/2006 Evans ..... A63B 21/026 482/121
7,163,500 B2 1/2007 Endelman et al.
7,172,538 B2 2/2007 Keiser
7,931,570 B2 * 4/2011 Hoffman ..... A63B 23/03533 482/129
8,317,667 B1 * 11/2012 Thomas ..... A63B 21/0421 482/121
8,485,950 B2 7/2013 Adams
8,485,951 B1 7/2013 Adams
8,562,492 B2 10/2013 Gerschefske et al.
8,840,075 B2 * 9/2014 Dalebout ..... A63B 21/00065 482/904
9,005,086 B1 4/2015 O'Neil
9,028,381 B2 * 5/2015 Mestemaker ..... A63B 21/154 482/130
9,108,079 B2 * 8/2015 Solow ..... A63B 22/0089
9,643,042 B2 5/2017 Madden
2001/0046928 A1 11/2001 Nette
2003/0023270 A1 1/2003 Danz et al.
2003/0069112 A1 4/2003 Williams
2003/0195095 A1 10/2003 Endelman
2003/0232707 A1 12/2003 Dalebout
2004/0166999 A1 8/2004 Dodge
2005/0113223 A1 5/2005 Dovner
2009/0247376 A1 10/2009 Merrithew
2009/0291768 A1 * 11/2009 Habing ..... A63G 13/08 472/113
2010/0173759 A1 * 7/2010 Lalaoua ..... A63B 21/4005 482/121
2010/0304939 A1 12/2010 Svenberg
2010/0323856 A1 12/2010 Svenberg

(56) References Cited

U.S. PATENT DOCUMENTS

| | | | | |
|---|---|---|---|---|
| 2011/0143894 | A1 | 6/2011 | Castel | |
| 2012/0142503 | A1 | 6/2012 | Sevadjian et al. | |
| 2013/0035220 | A1 | 2/2013 | Adams | |
| 2013/0072361 | A1* | 3/2013 | Ellis | A63B 22/0087 482/129 |
| 2013/0190148 | A1* | 7/2013 | Allison | A63B 21/0442 482/129 |
| 2014/0031182 | A1 | 1/2014 | Donofrio | |
| 2014/0069475 | A1 | 3/2014 | Lenhart | |
| 2014/0141948 | A1 | 5/2014 | Aronson et al. | |
| 2015/0133276 | A1 | 5/2015 | Kaye et al. | |
| 2016/0074691 | A1* | 3/2016 | Pearce | A63B 71/0054 482/121 |
| 2016/0193490 | A1* | 7/2016 | Chen | A63B 23/12 482/126 |
| 2017/0144009 | A1* | 5/2017 | Pearce | A63B 21/0004 |
| 2018/0021616 | A1 | 1/2018 | Orady et al. | |
| 2018/0169464 | A1* | 6/2018 | Janowski | A63B 22/0089 |
| 2019/0175973 | A1* | 6/2019 | An | A63B 21/0428 |
| 2019/0275362 | A1* | 9/2019 | Endelman | A63B 21/1609 |

FOREIGN PATENT DOCUMENTS

| | | | |
|---|---|---|---|
| CN | 201768299 | U | 3/2011 |
| CN | 203075534 | U | 7/2013 |
| CN | 203763761 | U | 8/2014 |
| CN | 106218788 | A | 12/2016 |
| DE | 102004013737 | A1 | 10/2005 |
| FR | 541324 | A | 7/1922 |
| FR | 2629071 | A1 | 9/1989 |
| WO | 8602009 | A1 | 4/1986 |
| WO | 198602009 | A1 | 4/1986 |

OTHER PUBLICATIONS

European Search Report and Written Opinion dated Oct. 21, 2019 for European Patent Application No. 17762372.5.

https://www.tonal.com/.

International Search Report and the Written Opinion dated Nov. 2, 2017.

* cited by examiner

RESISTANCE-GENERATING DEVICE, EXERCISE APPARATUS, AND METHOD

CROSS-REFERENCE TO RELATED APPLICATIONS

This is a continuation-in-part application of U.S. patent application Ser. No. 16/323,549, which is a national stage filing under 35 U.S.C. 371 of PCT application number PCT/CA2017/050969 filed Aug. 16, 2017, which designates the United States, was published in English, and claims the priority of U.S. provisional patent application No. 62/375,940 filed on Aug. 17, 2016, the entire contents of all of which are incorporated by reference herein.

TECHNICAL FIELD

The application relates generally to force-generating objects and, more particularly, to a resistance-generating device.

BACKGROUND

Various devices exist for performing resistance or load-bearing exercises. Conventional weight-bearing devices are often heavy and cumbersome. Many small apartments or homes, campers, hotel rooms, gyms, etc. cannot support these structures. Size, space and weight constraints inhibit the use and the availability of these devices.

Furthermore, effective weight-training requires continuously increasing the resistance or load. Many devices are restricted in the amount of resistance that can be added, which limits their usefulness.

SUMMARY

There is disclosed a resistance-generating device, comprising: an elongated resilient body having opposed ends, a first mounting member attached to the resilient body at one of the ends, and a second mounting member attached to the other end of the resilient body, the first and second mounting members being made of an inelastic material, at least one of the first and second mounting members being removably mountable to a corresponding one of the first and second mounting members of another device, the first mounting member being removably mountable to a first structure and the second mounting member being removably mountable to a second structure being displaceable relative to the first structure, the resilient body generating resistance upon being elastically deformed by displacement of the second mounting member mounted to the second structure relative to the first mounting member mounted to the first structure.

In an embodiment, at least one of the first and second mounting members includes a first surface having a mounting feature, and a second surface having a receiving feature, the mounting feature of each device being removably mountable to the receiving feature of another device.

In an embodiment, the mounting feature is a projection extending outwardly from the first surface, and the receiving feature is a recess extending into the second surface.

In an embodiment, the projection and the recess have complementary shapes.

In an embodiment, each of the first and second mounting members have the mounting feature and the receiving feature, the first and second mounting members having a same construction.

In an embodiment, the resilient body is a resilient band.

In an embodiment, at least one of the first mounting member, the second mounting member, and the resilient body have a visual indicia indicative of a resistance of the device.

In an embodiment, there is provided a set of the resistance-generating device, wherein at least one of the first and second mounting members of each device are removably mountable to the corresponding first and second mounting members of another device to increase a resistance provided by the set.

In an embodiment, at least two devices of the set have a common first or second mounting member, the other first or second mounting members of the at least two devices being separate.

In an embodiment, only one of the first or second mounting members of one of the devices of the set is removable from the corresponding first and second mounting members of another device to detach said device from the set.

In another aspect, there is provided a method of generating resistance, comprising: connecting one end of a first resilient body to a stationary first structure; connecting another end of the first resilient body to a displaceable second structure; connecting one end of at least another resilient body to one of the ends of the first resilient body; and displacing the second structure relative to the first structure to elastically deform at least the first resilient body to generate resistance.

In an embodiment, the method further comprises disconnecting at least one end of the at least one another resilient body from the corresponding end of the first resilient body to decrease the resistance.

In an embodiment, disconnecting at least one end of the at least one another resilient body includes disconnecting only one end of the at least one another resilient body from the corresponding end of the first resilient body while maintaining the other end of the at least one another resilient body connected to the corresponding end of the first resilient body.

In an embodiment, connecting one end of the at least another resilient body includes connecting the ends of multiple resilient bodies together to form a set of resilient bodies, a resistance of the set being greater than a resistance of any one of the resilient bodies alone.

There is disclosed an exercise apparatus, comprising: a first structure spaced apart from a second structure, the second structure being displaceable relative to the first structure; and at least one resistance-generating device having an elongated resilient body having opposed ends, a first mounting member attached to the resilient body at one of the ends, and a second mounting member attached to the other end of the resilient body, the first and second mounting members being made of an inelastic material, at least one of the first and second mounting members being removably mountable to a corresponding one of the first and second mounting members of another device, the first mounting member being removably mountable to the first structure and the second mounting member being removably mountable to the second structure, the resilient body generating resistance upon being elastically deformed by displacement of the second mounting member mounted to the second structure relative to the first mounting member mounted to the first structure.

In an embodiment, at least one of the first and second mounting members includes a first surface having a mounting feature, and a second surface having a receiving feature, the mounting feature of each device being removably mountable to the receiving feature of another device.

In an embodiment, the mounting feature is a projection extending outwardly from the first surface, and the receiving feature is a recess extending into the second surface.

In an embodiment, the projection and the recess have complementary shapes.

In an embodiment, each of the first and second mounting members have the mounting feature and the receiving feature, the first and second mounting members having a same construction.

In an embodiment, the resilient body is a resilient band.

In an embodiment, at least one of the first mounting member, the second mounting member, and the resilient body have a visual indicia indicative of a resistance of the at least one device.

In an embodiment, the at least one resistance-generating device includes a set of resistance-generating devices, at least one of the first and second mounting members of each device are removably mountable to the corresponding first and second mounting members of another device to increase a resistance provided by the set.

In an embodiment, at least two devices of the set have a common first or second mounting member, the other first or second mounting members of the at least two devices being separate.

In an embodiment, only one of the first or second mounting members of one of the devices of the set is removable from the corresponding first and second mounting members of another device to detach said device from the set.

There is disclosed a resistance-generating device, comprising: a resilient body extending between opposed ends, a first mounting member attached to the resilient body at one of the ends and a second mounting member attached to the other end of the resilient body, the resilient body having a first portion extending between the first and second mounting members and a second portion extending between the first and second mounting members, the first portion being spaced apart from the second portion, the first and second mounting members being made of an inelastic material, at least one of the first and second mounting members being removably mountable to a corresponding one of the first and second mounting members of another resistance-generating device, the first mounting member being removably mountable to a first structure and the second mounting member being removably mountable to a second structure being displaceable relative to the first structure, the resilient body generating resistance upon the first and second portions being elastically deformed by displacement of the second mounting member mounted to the second structure relative to the first mounting member mounted to the first structure.

There is disclosed a method of adjusting a resistance-generating device, comprising: displacing parts of the resistance-generating device positioned at opposed ends of the resistance-generating device to another position in which the parts of the resistance-generating device are positioned between the opposed ends.

There is disclosed an exercise apparatus, comprising: a first structure spaced apart from a second structure, the second structure being displaceable relative to the first structure; and one or more resistance-generating devices having a resilient body extending between opposed ends, a first mounting member attached to the resilient body at one of the ends and a second mounting member attached to the other end of the resilient body, the resilient body having a first portion extending between the first and second mounting members and a second portion extending between the first and second mounting members, the first portion being spaced apart from the second portion, the first and second mounting members being made of an inelastic material, at least one of the first and second mounting members being removably mountable to a corresponding one of the first and second mounting members of another resistance-generating device, the first mounting member being removably mountable to the first structure and the second mounting member being removably mountable to the second structure, the resilient body generating resistance upon the first and second portions being elastically deformed by displacement of the second mounting member mounted to the second structure relative to the first mounting member mounted to the first structure.

DESCRIPTION OF THE DRAWINGS

Reference is now made to the accompanying figures in which.

DETAILED DESCRIPTION

Figure 1:
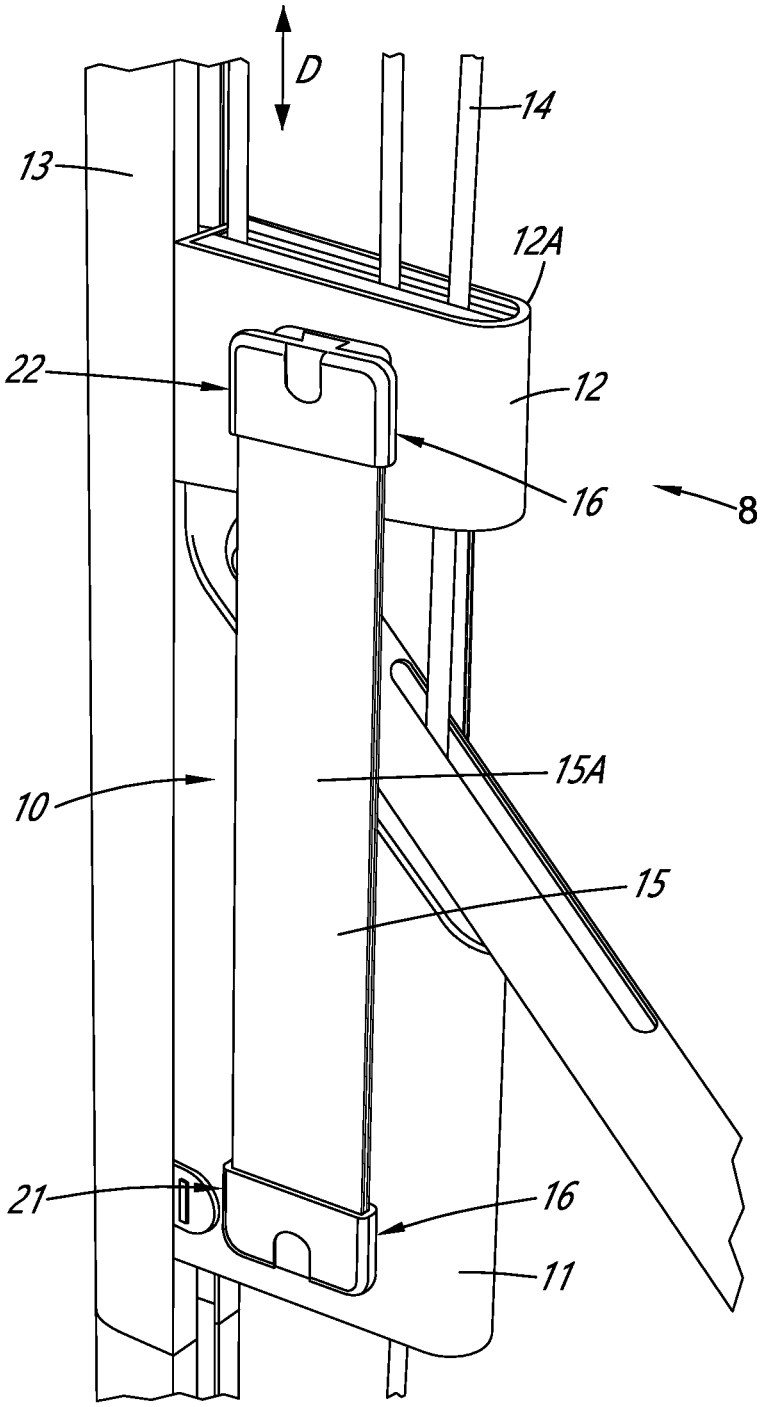
FIG. 1 is a perspective view of a resistance-generating device mounted to a first structure and to a second structure, according to an embodiment of the present disclosure.

FIG. 1 illustrates an exercise apparatus 8. The exercise apparatus 8 can be used by a person in a training or exercise regimen. The exercise apparatus 8 includes a first structure 11 and a spaced-apart second structure 12. The first structure 11 and second structure 12 are displaceable relative to one another. In the depicted embodiment, the first structure 11 is a stationary object that does not displace, and the second structure 12 is a moveable object which displaces along direction D toward and away from the first structure 11. Other configurations for the displacement of the second structure 12 relative to the first structure 11 are also possible. For example, both the first and the second structures 11,12 can be displaceable. The first and second structures 11,12 can be any body, object, or member which allows for the above-described relative displacement of the exercise apparatus 8. In the depicted embodiment, the second structure 12 has a pulley-housing body 12A enclosing a pulley. The pulley-housing body 12A is slidingly displaceable in direction D along support post 13 when cables 14 actuate the pulley. The first structure 11 shown in FIG. 1 is a block or protrusion that is fixedly attached to the support post 13, such that the pulley-housing body 12A is able to displace in the direction D relative to the first structure 11 (i.e. away from the first structure 11 and towards the first structure 11, along direction D).

FIG. 1 also illustrates a resistance-generating device 10 mounted to the first structure 11 and to the second structure 12. The resistance-generating device 10 is mounted to the first and second structures 11,12 such that it can be easily removed therefrom. As will be explained in greater detail below, the displacement of the second structure 12 relative to the first structure 11 causes the resistance-generating device 10 attached to the first and second structure 11,12 to generate resistance. In the depicted embodiment, the resistance-generating device 10 (referred to herein sometimes simply as "device 10") generates resistance when the second structure 12 is displaced away from the first structure 11. The device 10 may also generate resistance in other ways. For example, the configuration of the first and second structures 11,12 and the attachment of the device 10 thereto may allow the device 10 to generate resistance through the relative displacement of the first and second structures 11,12 toward one another. The resistance generated can be used for any suitable purpose. For example, in the depicted embodiment, the resistance generated by device 10 is used by a person in a training or exercise regimen.

Still referring to FIG. 1, the device 10 has an elongated resilient body 15. The resilient body 15 (referred to herein sometimes simply as "body 15") is an object having a length, and extends between two opposed ends 16. The body 15 is elastically deformable and returns to its original form or configuration after being stretched. The resistance of the body 15 to deformation is what generates the resistance of the device 10. The resiliency of the body 15 can be obtained from the material from which it is made. For example, the body 15 can be made from any suitable polymer material which undergoes elastic deformation. For example, the body 15 can be made from any suitable elastomeric material which undergoes elastic deformation. The material of the body 15 can be a naturally-occurring or synthetic elastomer, such as natural rubber, butyl rubber, or neoprene. In the depicted embodiment, the body 15 is in the form of a resilient band 15A. The body 15 may take other forms as well. For example, the body 15 can be in the form of a resilient elongated cylinder, or can be in the form of a hollow resilient tube. Even more possible forms for the body 15 are described in greater detail below.

The device 10 also has a first mounting member 21 and a second mounting member 22. The first mounting member 21 is disposed at one of the ends 16 of the body 15, and the second mounting member 22 is disposed at the other end 16 of the body 15. Each of the first and second mounting members 21,22 is a separate component from the body 15, and is attached or connected to their respective ends 16 of the body 15, or integral therewith. In the depicted embodiment, the first and second mounting members 21,22 are permanently attached to the body 15. In an alternate embodiment, the first and second mounting members 21,22 are removably mounted to the ends 16 of the body 15.

In the depicted embodiment, the first and second mounting members 21,22 are also removably mounted to the first and second structures 11,12, respectively. By mounting to the first and second structures 11,12, the first and second mounting members 21,22 link the body 15 to the relative displacement of the first and second structures 11,12, thereby allowing the body 15 to generate resistance. The resilient body 15 therefore generates resistance upon being elastically deformed by the displacement of the second mounting member 22 mounted to the second structure 12 relative to the first mounting member 21 mounted to the first structure 11. The relative displacement of the first and second mounting members 21,22 occurs when the first and second structures 11,12, to which they are attached, are displaced relative to one another.

The first and second mounting members 21,22 are made of an inelastic material. In contrast to the body 15, which undergoes elastic deformation, the first and second mounting members 21,22 are rigid and inflexible. Therefore, when the body 15 is undergoing elastic deformation, for example from tension being applied thereto by the relative displacement of the first and second structures 11,12, the first and second mounting members 21,22 will not significantly expand or enlarge in shape. The non-elasticity or rigidity of the first and second mounting members 21,22 allows the body 15 to be the principal generator of resistance in the device 10. Some non-limiting examples of materials from which the first and second mounting members 21,22 can be made include plastic, wood, metal, rigid elastomers, and composites or combinations thereof. In an embodiment, the material of the first and second mounting members 21,22 is not the same as the elastomeric material of the body 15. In another embodiment, the material of the first and second mounting members 21,22 is the same as the elastomeric material of the body 15, but the material of the first and second mounting members 21,22 is rigid and inflexible (e.g. a hard rubber material).

Figure 2A:
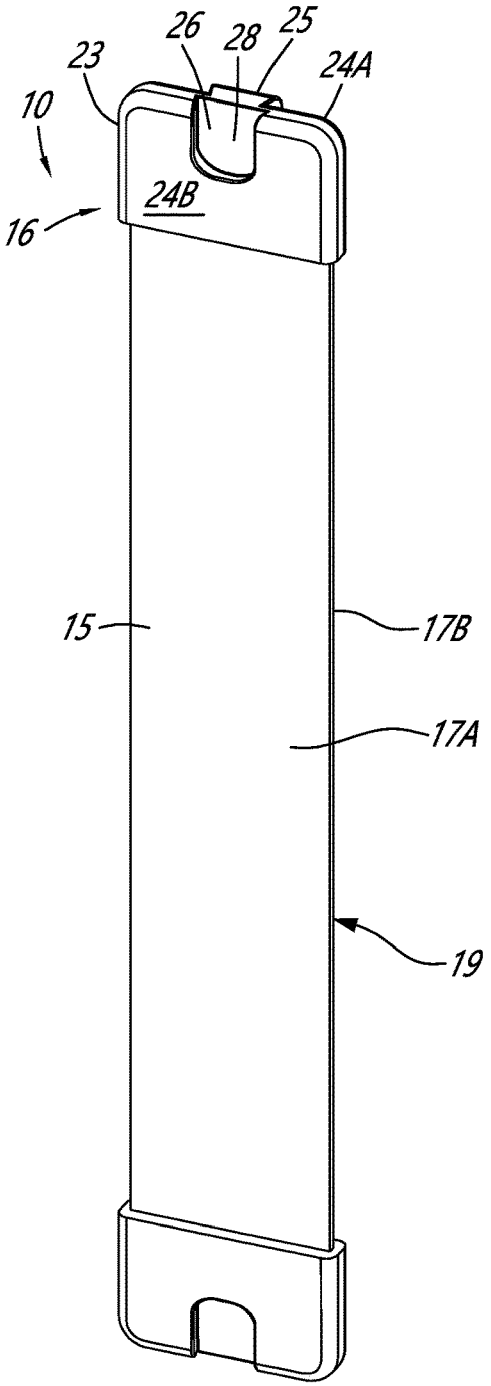
FIG. 2A is a perspective view of the resistance-generating device of FIG. 1.
Figure 2B:
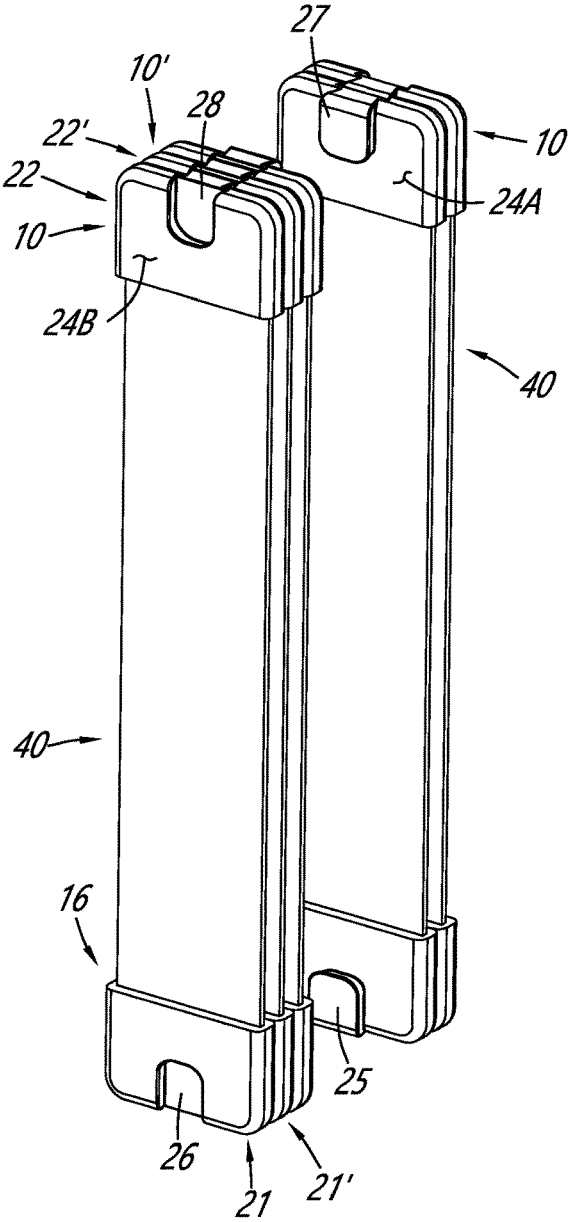
FIG. 2B is a perspective view of a plurality of the resistance-generating devices of FIG. 1.

FIGS. 2A shows a single device 10 as described above, and FIG. 2B shows a plurality or set 40 of the devices 10,10' connected together. As shown in FIG. 2B, each of the devices 10,10' in the set 40 is removably mounted to one another. This allows multiple devices 10,10' to be combined, or "stacked", together. In combining the devices 10,10' in this way, it is possible to increase the resistance generated. More particularly, the set 40 of devices 10,10' can be mounted to the first and second structures 11,12 and the combined resistance they generate will be greater than the resistance generated by any one of the devices 10,10' of the set 40 alone. It can thus be appreciated that the ability to removably mount or stack one device 10 to another device 10' allows the user to quickly and easily increase the resistance required for resistance-based exercise or training, for example. This "resistance multiplier" effect contrasts with trying to increase resistance with conventional free weights, which typically requires adding heavy or cumbersome weights about a space-occupying support.

Figure 4A:
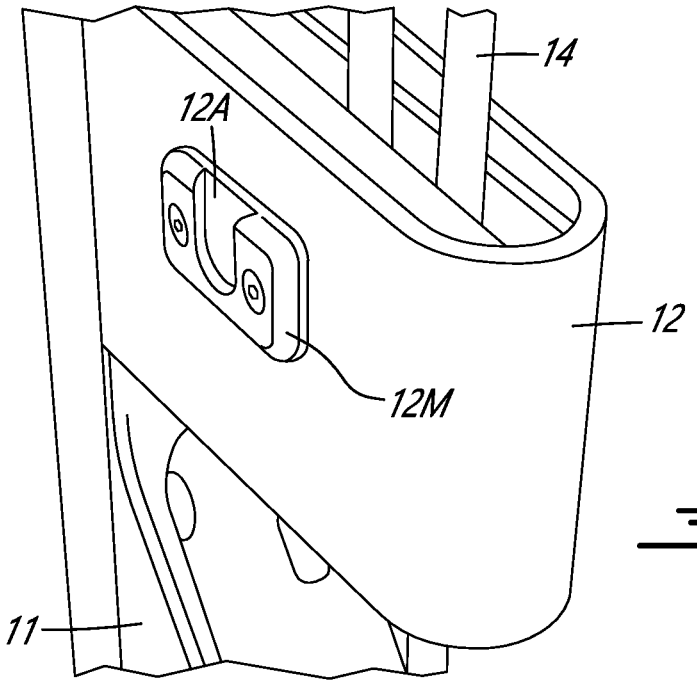
FIG. 4A is a perspective view of the second structure of FIG. 1 for receiving a resistance-generating device.
Figure 4B:
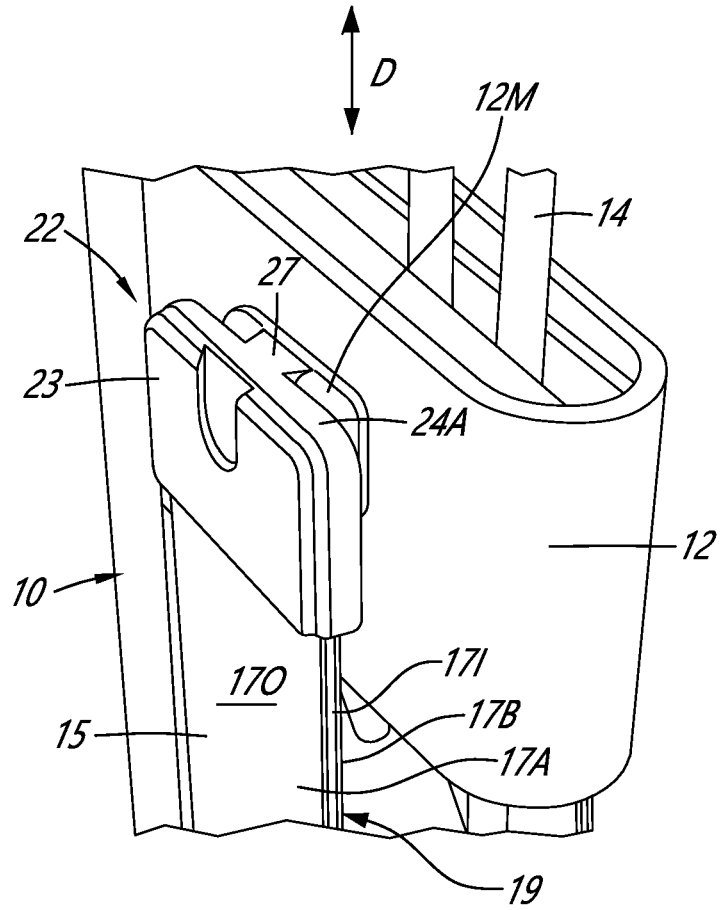
FIG. 4B is a perspective view of a mounting member of the resistance-generating device mounted to the second structure of FIG. 4A.

Another possible form for the body 15 is shown in FIG. 2A. The body 15 has a first portion 17A and a second portion 17B (see FIG. 4B as well). The first and second portions 17A,17B are parts or segments of the body 15, or make up the body 15, so as to have the same characteristics as the body 15 described above. The first and second portions 17A,17B are elastically deformable and return to their original form or configuration after being stretched. Each of the first and second portions 17A,17B extend between, and are mounted to, the first and second mounting members 21,22, so that the first and second portions 17A,17B generate resistance upon being elastically deformed by the displacement of the second mounting member 22 mounted to the second structure 12 relative to the first mounting member 21 mounted to the first structure 11. Referring to FIGS. 2A and 4B, the first portion 17A is spaced apart from the second portion 17B. Referring to FIGS. 2A and 4B, the first portion 17A is spaced apart from the second portion 17B in a direction that is transverse or perpendicular to the length of the device 10. A lateral gap is defined between the first and second portions 17A,17B of the body 15. The first and second portions 17A,17B extend along the entire length of the device 10 between, or possibly into, the first and second mounting members 21,22. Referring to FIG. 4B, each of the first and second portions 17A,17B have an inner surface 17I and an outer surface 17O. The inner surfaces 171 of the first and second portions 17A,17B face each other across the lateral gap. The outer surface 170 of the first and second portions 17A,17B face away from each other across the lateral gap. The first and second portion 17A,17B may be defined by the mounting of the body 15 to the first and second mounting members 21,22, as explained in greater detail below.

The removable mounting of one device 10 to another device 10' can take different forms. In FIG. 2B, the first and second mounting members 21,22 of one device 10 are removably mounted to the corresponding first and second mounting members 21',22' of another device 10'. Other configurations for removably mounting one device 10 to another device 10' are possible. For example, in an alternate embodiment, the two devices 10,10' share a common first or second mounting member 21,22 at one end 16 of the body 15, and have separate first and second mounting members 21,22 at the other end of the body 15. This configuration is represented in FIG. 2B, where two devices 10,10' are shown having a common first mounting member 21'. In such a configuration, the resistance of the devices 10,10' can be combined by removably mounting only the separate corresponding first and second mounting members 21,22 together. Similarly, in such a configuration, the resistance of the devices 10,10' can be decoupled by disconnecting only the separate corresponding first and second mounting members 21,22.

Figure 2C:
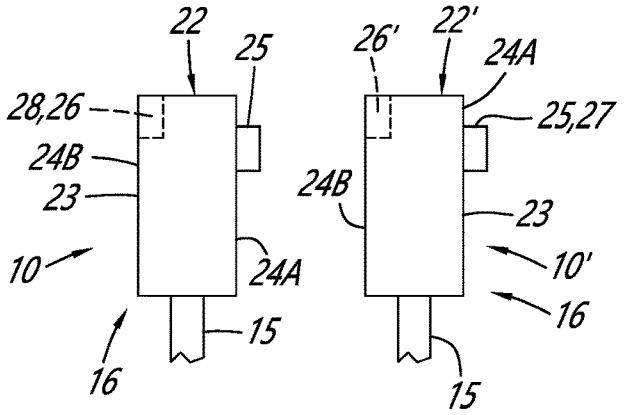
FIG. 2C is a schematic side view of part of two of the resistance-generating devices of FIG. 1.

Referring to FIGS. 2A to 2C, each of the first and second mounting members 21,22 includes an end cap 23 secured to one of the ends 16 of the body 15. The end cap 23 is a molded plastic piece that is secured to the end 16 of the body 15 during a molding manufacturing procedure. The end cap 23 has a first surface 24A and a second surface 24B disposed opposite to the first surface 24A on the other side of the end cap 23. The first surface 24A has a mounting feature 25 and the second surface 24B has a receiving feature 26. The mounting feature 25 of one device 10 is removably mountable to the receiving feature 26' of another device 10', which allows the devices 10,10' to be combined together.

In the depicted embodiment, each mounting feature 25 includes a projection 27 extending outwardly from the first surface 24A. Each receiving feature 26 includes a groove or recess 28 in the second surface 24B. As shown in FIG. 2C, the shape of the projection 27 corresponds to that of the recess 28 so that the projection 27 can be inserted into the recess 28 and secured therein, thereby combining corresponding first and second mounting members 21,22 and first and second devices 10,10'. The shape of the projection 27 and recess 28 can vary. For example, in the depicted embodiment, the projection 27 and the recess 28 have complementary shapes. The projection 27 has a U-shape, and the recess 28 also has a U-shape as it extends into the second surface 24B. In order to connect corresponding first and second mounting members 21,22, the U-shaped projection 27 of one mounting member is slid into the U-shaped recess 28 of a corresponding mounting member. It will be appreciated that the configuration of the mounting feature 25 and the receiving feature 26 can vary, and is not limited to the depicted configuration. Another embodiment of the mounting and receiving features 25,26 is described below. In other embodiments, the mounting feature 25 and receiving feature 26 can also be another configuration of male-female mating objects, a hook-and-loop fastener, a biased mechanism, magnets, or any other suitable mechanical connection.

Referring to FIGS. 2B and 2C, it can be appreciated that decreasing the resistance generated by the set 40 can also be easily achieved through the removable mounting of the first and second mounting members 21,22 of one device 10 to those of another device 10'. More particularly, if the user wishes to reduce the resistance generated by the set 40, she can simply detach or decouple one or both of the first and second mounting members 21,22 of one device 10 from the corresponding first and second mounting member 21',22' of another device 10'. If desired, only one of the first or second mounting members 21,22 of one device 10 is removed from the corresponding first and second mounting member 21',22' of another device 10', while maintaining the other mounting member 21,22 of the device 10 connected to the corresponding mounting member 21',22' of the other device 10'. This disconnection allows the user to detach only part of one device 10 from the set 40, thereby providing a reduction in resistance without having to disconnect the entirety of the device 10. Since one of the mounting members is no longer attached to the remainder of the devices 10 of the set 40, the device 10 corresponding to that mounting member will not generate resistance when its body 15 undergoes elastic deformation. If the user wishes to increase the resistance of the set 40, she can quickly reattach the detached mounting member 21,22. This functionality allows the user of the set 40 to quickly modify (i.e. increase and decrease) the resistance generated by a set 40 of devices 10.

Figure 3:
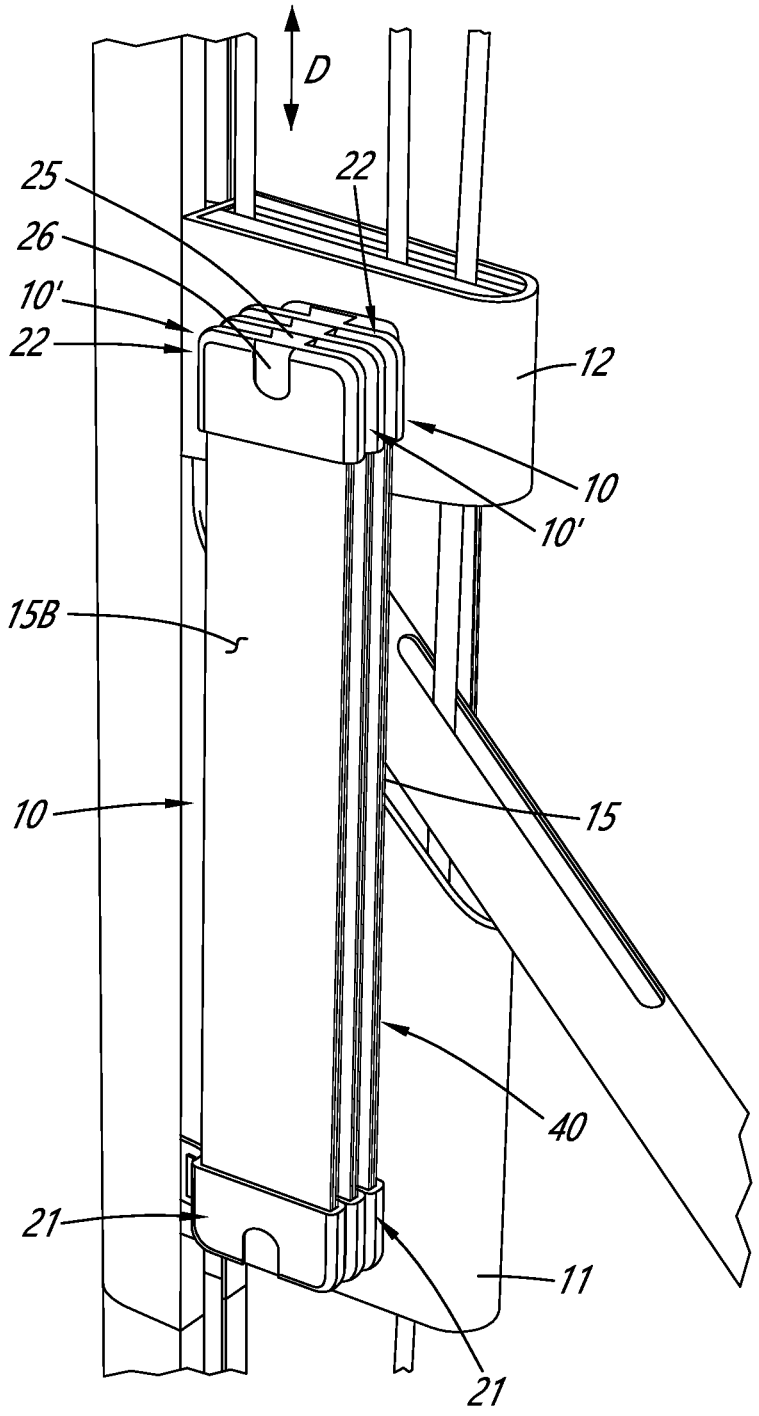
FIG. 3 is a perspective view of a plurality of the resistance-generating devices mounted to the first structure and to the second structure of FIG. 1.

FIG. 3 shows the set 40, wherein one of its devices 10 is removably mounted to the first and second structures 11,12. More particularly, the first mounting member 21 of the device 10 is mounted to the first structure 11, and the second mounting member 22 is mounted to the second structure 12. The remaining devices 10' of the set 40 are combined together by mounting the first and second mounting members 21,22 of each device 10' together. As the second structure 12 is displaced along direction D relative to the first structure 11, the second mounting members 22 of all the devices 10,10' are also displaced, thereby causing the bodies 15 of the devices 10,10' to generate resistance. If the user wishes to decrease the resistance generated by the set 40, she can simply detach or decouple one or more mounting members 21,22 of each device 10,10' from the corresponding mounting member 21,22 of another device 10,10'.

In the depicted embodiment, each of the devices 10,10' have one or more visual indicia 15B which provides information to the user on the resistance provided by the device 10. In the depicted embodiment, the visual indicia 15B is a colour that is unique to each device 10, each colour being indicative of the stiffness of the body 15, or how much resistance it generates. Other visual indicia including, but not limited to, markings, number, alphanumeric characters, or symbols, may also be used to indicate resistance. The visual indicia 15B may also be provided on one of, or both, of the first and second mounting members 21,22, or as an alternative or in addition to being provided on the body 15.

It can thus be appreciated that the user can select a device 10 whose resistance is similar to that generated by a 10 lbs free weight, for example. The user can combine this device 10 with another device 10 whose colour is indicative of a resistance similar to that generated by a 20 lbs free weight. The combined resistance of this set 40 of devices 10,10' will be similar to that generated by lifting 30 lbs of free weights.

In the depicted embodiment, each of the first and second mounting members 21,22 of each device 10,10' have the mounting feature 25 and the receiving feature 26. This allows the device 10,10' to be reversed because each mounting member 21,22 is compatible with either one of the mounting members 21,22 of another device 10'. The first and second mounting members 21,22 of each device 10 therefore have the same construction or structure.

An example of the operation of the device 10 is explained with reference to FIGS. 4A and 4B. The end cap 23 of the second mounting member 22 is mounted to the displaceable second structure 12. The second structure 12 has a structure mount 12M. The structure mount 12M is fixed in position on the second structure 12 and displaces with the second structure 12. The structure mount 12M is shaped and sized to removably receive one of the first and second mounting members 21,22 of one of the devices 10,10'. More particularly, the dovetail projection 27 from the first surface 24A of the end cap 23 is slid into a similarly shaped recess 12A of the structure mount 12M. The first mounting member 21 is similarly mounted to a structure mount 12M on the stationary first structure 11. In order to generate resistance, the user applies force to an exercise accessory which is linked to the first and second structure 11,12 via cables 14 and pulleys. The tension this creates in the cables 14 causes the second structure 12, the structure mount 12M, and the second mounting member 22 mounted thereto to displace relative to the first structure 11 (and relative to the first mounting member 21 mounted thereto) along direction D. The body 15 is thus stretched, which generates the resistance of the device 10.

Figure 5A:
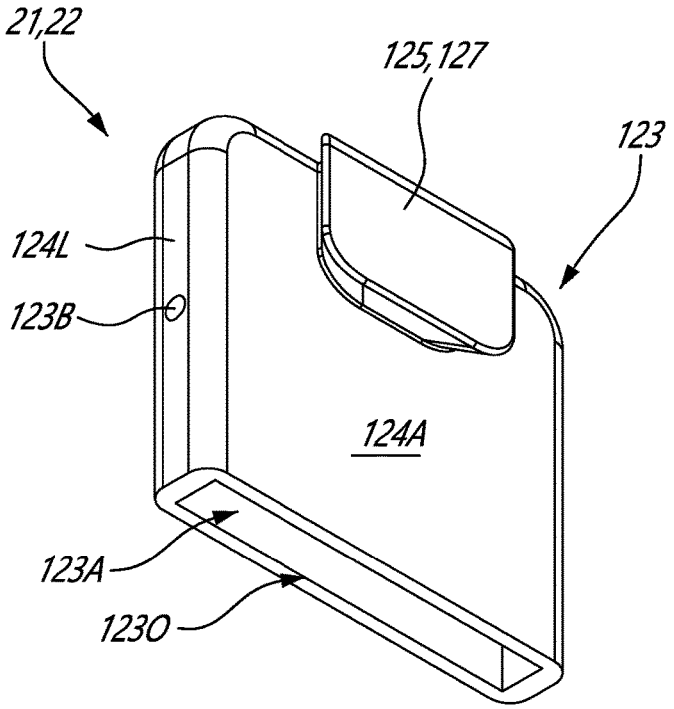
FIG. 5A is a perspective view of an end cap for a resistance-generating device, according to another embodiment of the present disclosure.
Figure 5B:
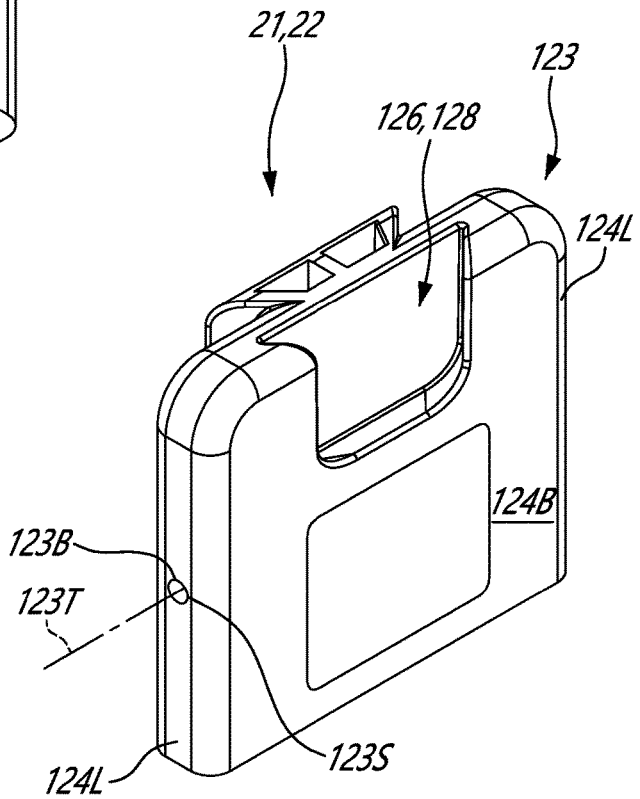
FIG. 5B is another perspective view of the end cap of FIG. 5A.
Figure 5C:
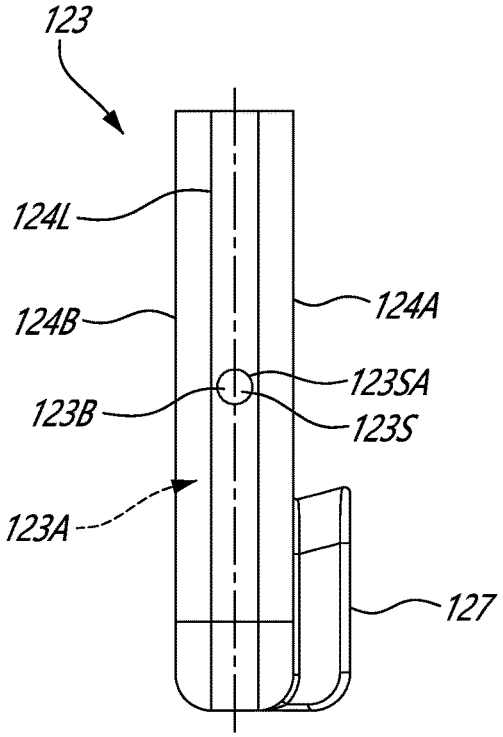
FIG. 5C is a side elevational view of the end cap of FIG. 5A.

FIGS. 5A to 5C show another embodiment of the end cap 123 of the first and second mounting members 21,22. The end cap 123 is a molded plastic piece that is secured to the end 16 of the body 15 during a molding manufacturing procedure. The end cap 123 has a first surface 124A and a second surface 124B disposed opposite to the first surface 124A on the other side of the end cap 123. The first surface 124A has a mounting feature 125 and the second surface 124B has a receiving feature 126. The mounting feature 125 of one device 10 is removably mountable to the receiving feature 126 of another device 10', which allows the devices 10,10' to be combined together. The shape of the projection 127 corresponds to that of the recess 128 so that the projection 127 can be inserted into the recess 128 and secured therein, thereby combining corresponding first and second mounting members 21,22 and first and second devices 10,10'. In the depicted embodiment, the projection 127 and the recess 128 have complementary shapes. The projection 127 has a dovetail shape, and the recess 128 flares outwardly as it extends into the second surface 124B. In order to connect corresponding first and second mounting members 21,22, the dovetail projection 127 of one mounting member is slid into the flared recess 128 of a corresponding mounting member. It will be appreciated that the first and second structures 11,12 can have complementary shaped recesses to accommodate the projections 127.

Referring to FIGS. 5A to 5C, the end cap 123 is at least partially hollow. The end cap 123 defines an internal cavity 123A occupying a volume of the interior of the end cap 123. The cavity 123A is delimited by internal walls of the end cap 123, which also delimit an opening 123O leading into the cavity 123A. The cavity 123A is sized and shaped to receive therein, via the opening 123O, distal parts or extremities of the first and second portions 17A,17B of the body 15, as described in greater detail below. Other features of the end cap 123 are housed therein and located within the cavity 123A. Referring to FIGS. 5A to 5C, the end cap 123 has a support 123B. The support 123 is positioned within the end cap 123 and extends across the cavity 123A between opposed lateral walls 124L of the end cap 123. The support 123B is sized, shaped and arranged so as to support a distal part or extremity of the body 15 within the end cap 123, and helps to define the first and second portions 17A,17B of the body 15, as described in greater detail below. The support 123B may assume any suitable configuration to achieve such functionality. For example, and referring to FIGS. 5A to 5C, the support 123B is in the form of a shaft 123S that extends between the lateral walls 124L of the end cap 123. The shaft 123S is positioned midway between the first and second surfaces 124A,124B of the end cap 123. The shaft 123S is inserted through shaft apertures 123SA in the lateral walls 124 (see FIG. 9). The shaft 123S defines a shaft axis 123T. The shaft axis 123T is perpendicular to the lateral walls 124L. The shaft 123S is rotatable about the shaft axis 123T. The rotation of the shaft 123S allows for the body 15 mounted to the shaft 123S to displace with respect to the end cap 123. The rotation of the shaft 123S allows for another part or portion of the body 15 to be positioned against the shaft 123S within the end cap 123, as described in greater detail below. Other configurations for the support 123B are possible. For example, the support 123B may also be one or more of a bearing, a rod, a wheel, and a pulley, or any other rotatable body which supports the body 15 when placed under tension and accommodates its displacement relative to the first and second members 21,22. In an alternate configuration of the support 123B, the support 123B does not rotate and has a fixed position relative to the end cap 123. Such a support 123B also supports the body 15 when placed under tension and accommodates its displacement relative to the first and second members 21,22.

Figure 6:
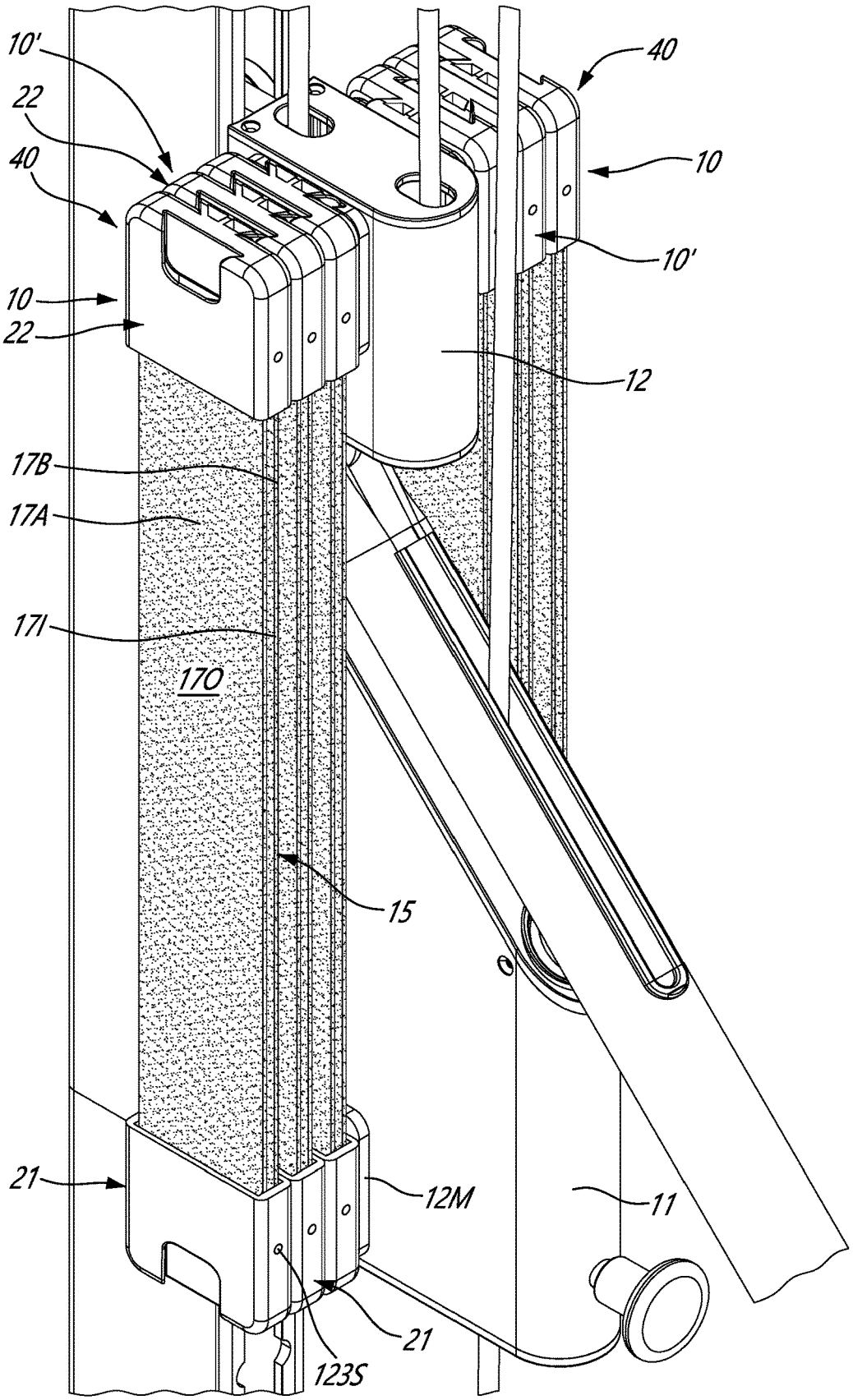
FIG. 6 is a perspective view of a plurality of the resistance-generating devices mounted to the first structure and to the second structure of FIG. 1.
Figure 7:
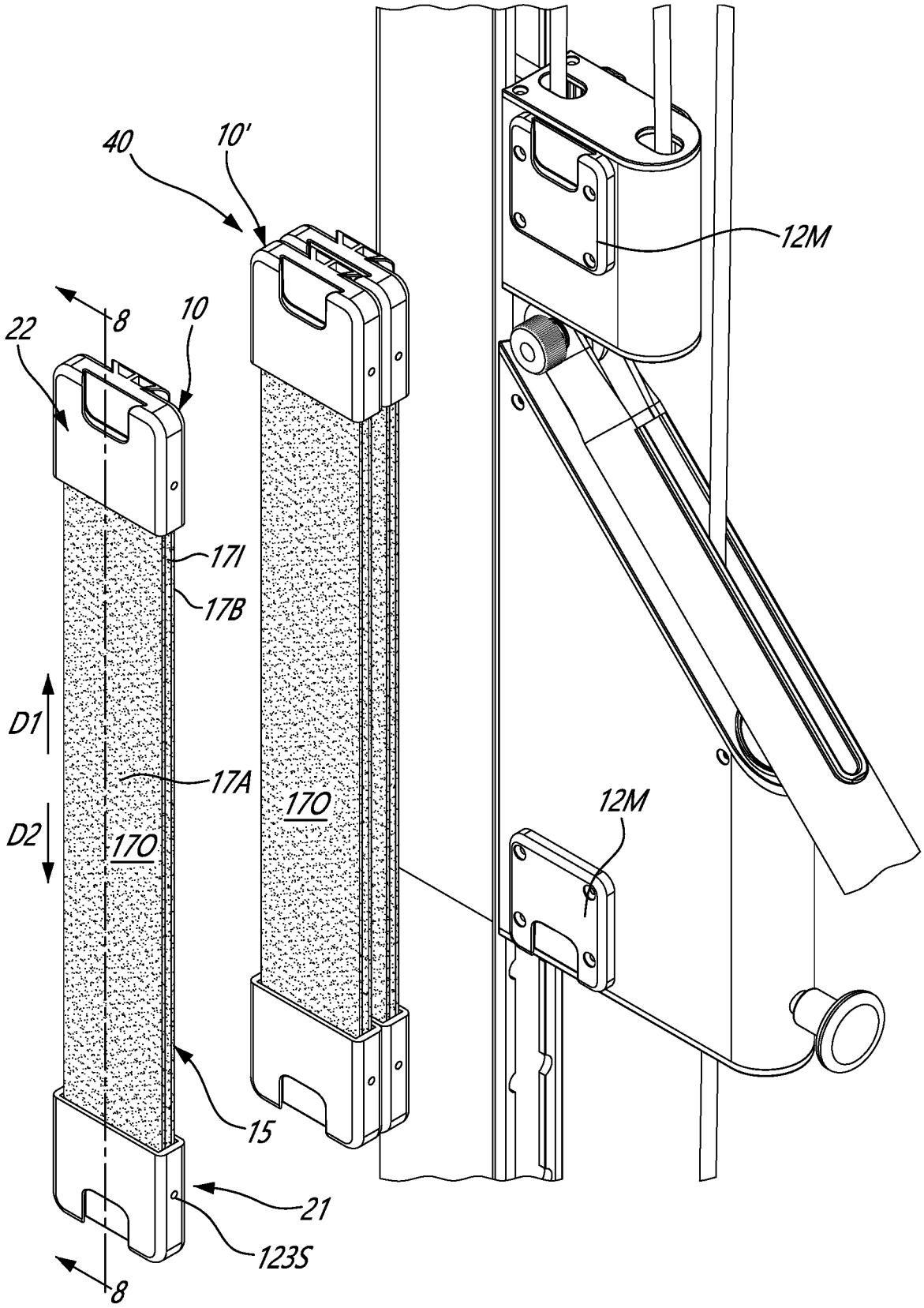
FIG. 7 is a perspective view of a plurality of the resistance-generating devices of FIG. 1.

Referring to FIGS. 6 and 7, a plurality or set 40 of the devices 10,10' are connected together. Each of the devices 10,10' in the set 40 is removably mounted to one another. This allows multiple devices 10,10' to be combined, or "stacked", together, as explained above. As explained above with reference to FIGS. 5A to 5C, the first and second portions 17A,17B of the resilient body 15 are displaceable relative to the first and second mounting members 21,22. The relative displaceability of the first and second portions 17A,17B may take different forms. In the embodiment shown in FIG. 7, each of the first and second portions 17A,17B can displace in the direction D1 toward the second mounting member 22, and also in the direction D2 toward the first mounting member 21. In an alternate form of the relative displaceability, each of the first and second portions 17A,17B can displace in only one the directions D1,D2, either in the same direction or in different directions.

By being displaceable relative to the first and second mounting members 21,22, the first and second portions 17A,17B of the resilient body 15 are able to change the part of the resilient body 15 that is attached or mounted to the first and second mounting members 21,22. When the body 15 is resiliently deformed and contracted at a high frequency by the relative displacement of the first and second mounting members 21,22, such as during a high-intensity or cardiovascular workout, the parts of the body 15 which are attached or mounted to the first and second mounting members 21,22 may experience wear or strain. Prolonged or repeated exposure of these parts of the body 15 to this cyclic loading may cause these parts to fatigue, lose their resiliency, or tear. However, by displacing the first and second portions 17A,17B of the resilient body 15 relative to the first and second mounting members 21,22, the user is able to change the parts of the body 15 that are attached or mounted to the first and second mounting members 21,22 and that experience such wear, thereby helping to increase the longevity of the body 15 and of the device 10,10'.

Figure 8:
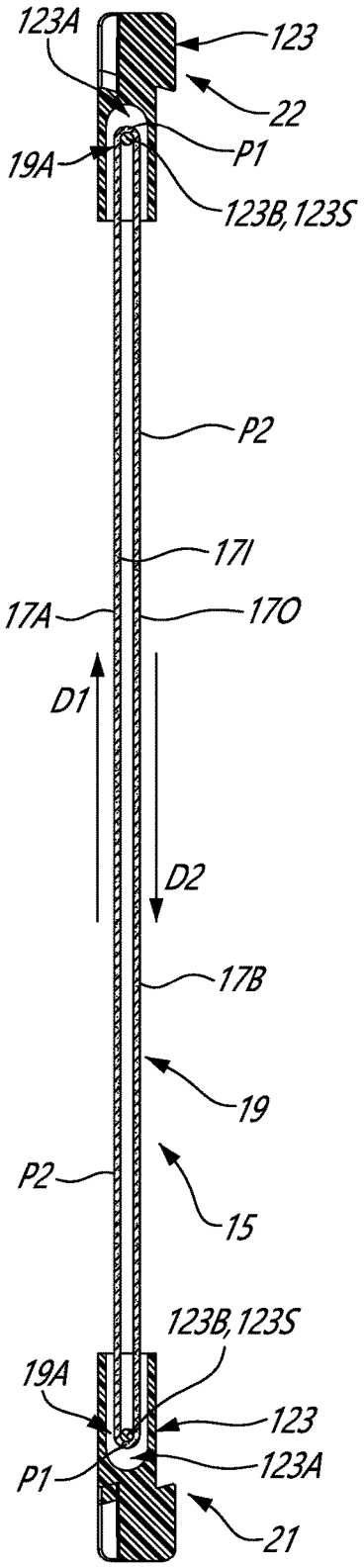
FIG. 8 is a cross-sectional view of one of the resistance-generating devices taken along the line 8-8 in FIG. 7.
Figure 9:
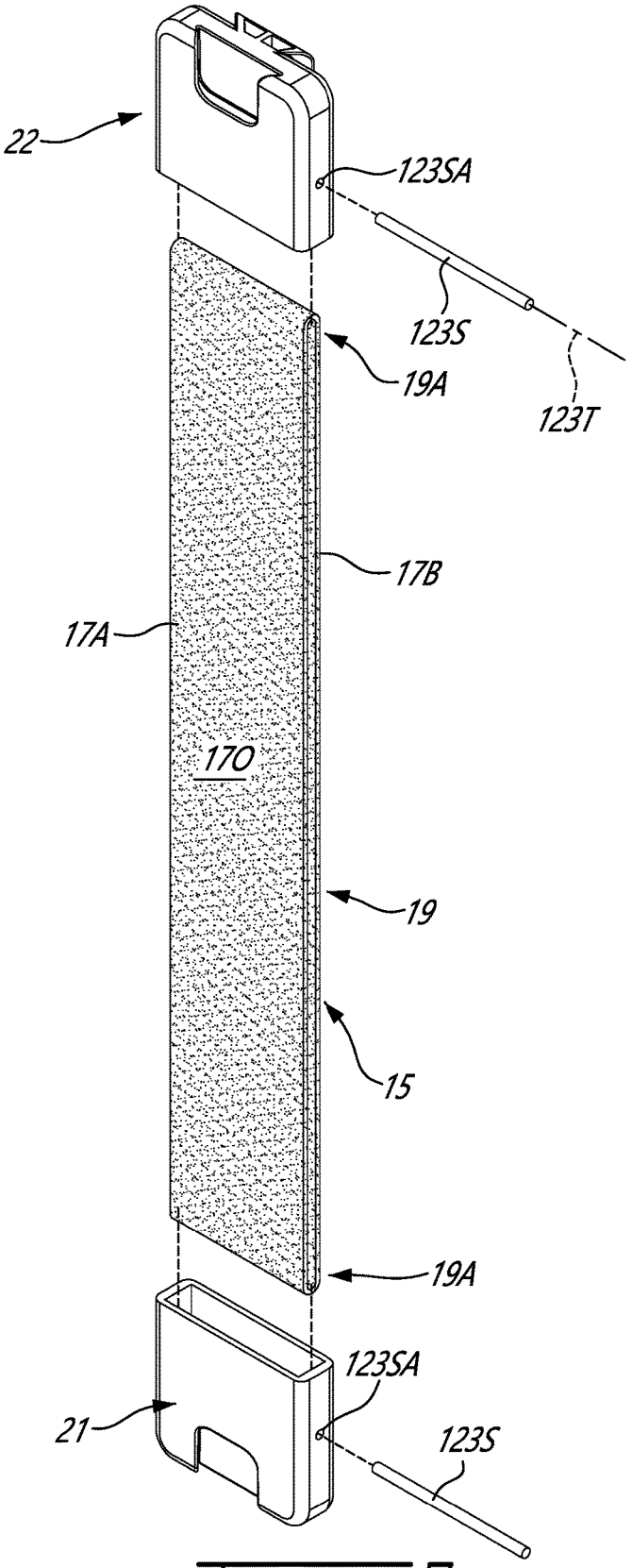
FIG. 9 is an exploded view of one of the resistance-generating devices.

FIGS. 8 and 9 show one possible configuration for how the first and second portions 17A,17B of the body 15 are mounted or attached to the first and second mounting members 21,22. The first and second portions 17A,17B are mounted to, or about, the supports 123B. The supports 123B are caused to rotate about their axes 123T when the first and second portions 17A,17B are displaced relative to the first and second mounting members 21,22. Some or all of the first and second portions 17A,17B travel through the cavity 123A of the end cap 123 and are spaced inwardly from the inner walls of the end cap 123 that define the cavity 123A. Thus, sections of the first and second portions 17A,17B, such as their distal ends, are permanently positioned in the cavity 123A and within the end cap 123 irrespective of the displacement of the first and second portions 17A,17B. Referring to FIG. 8, the length of each of the first and second portions 17A,17B is defined between the supports 123B.

Referring to FIGS. 8 and 9, the resilient body 15 is a loop 19 (see FIGS. 2A and 4B as well). The loop 19 is elastically deformable and returns to its original form or configuration after being stretched. The loop 19 extends between, and is mounted to, the first and second mounting members 21,22, so that the loop 19 generates resistance upon being elastically deformed by the displacement of the second mounting member 22 mounted to the second structure 12 relative to the first mounting member 21 mounted to the first structure 11. The loop 19 is a structure the end of which is connected to the beginning. In FIGS. 2A, 4B, 8 and 9, the loop 19 is an integral, one-piece, or monolithic body of elastomeric material. In an alternate embodiment, the loop 19 may be composed of two or more interconnected segments. In FIGS. 2A, 4B, 8 and 9, the loop 19 is a closed loop because there are no openings along its length. The loop 19 extends between opposed loop ends 19A. The first mounting member 21 is attached to the loop 19 at one of the loop ends 19A, and the second mounting member 22 is attached to the other loop end 19A. The loop 19 defines the first and second portions 17A,17B between the loop ends 19A.

The first and second portions 17A,17B are thus defined by the manner in which the loop 19 is mounted or attached to the first and second mounting members 21,22. Referring to FIGS. 8 and 9, one of the loop ends 19A is mounted about the shaft 123S within the second mounting member 22, and the other loop end 19A is mounted about the shaft 123S within the first mounting member 21. Portions of the loop 19 are thus spaced apart from each other by the shafts 123S. Portions of the loop 19 are thus spaced apart from each other by the diameter of the shafts 123S. The shafts 123S therefore define the first and second portions 17A,17B of the loop 19. Referring to FIGS. 8 and 9, the loop 19 is displaceable relative to the first and second mounting members 21,22. More particularly, the loop 19 is displaceable in a looping, repeating or recurrent motion about the shafts 123S and relative to the first and second mounting members 21,22, such that displacement of the loop 19 causes the shafts 123S to rotate about their shaft axes 123T. During this looping motion, the portions of the loop 19 repeatedly travel over the same path as they are displaced relative to the first and second mounting members 21,22.

Referring to FIG. 8, the user may adjust the device 10 as follows. When parts of the loop 19 at positions P1 begin to experience wear or prior to the parts experiencing wear, the user may pull or push on the first and/or second portions 17A,17B of the loop 19. This will cause the shafts 123S to rotate about their shaft axes 123T. This will also cause the first and second portions 17A,17B to simultaneously displace relative to the first and second mounting members 21,22. For example, and as shown in FIG. 8, the first portion 17A will displace in direction D1 toward the second mounting member 22 while the second portion 17B will simultaneously displace in the direction D2 toward the first mounting member 21. The first portion 17A is thus displaceable toward the first mounting member 21 such that the second portion 17B is simultaneously displaceable toward the second mounting member 22, and the first portion 17A is displaceable toward the second mounting member 22 such that the second portion 17B is simultaneously displaceable toward the first mounting member 21. The user can displace the first and/or second portion 17A,17B until the parts of the loop 19 previously at positons P1 arrive at positions P2. The positions P2 may be any positions of the loop 19 that are not positions P1. The positions P2 may be any positions of the loop 19 between the loop ends 19A. It thus follows that another non-worn or non-strained parts of the loop 19 can be placed into contact with the shafts 123S at positons P1, and potentially worn or strained parts of the loop 19 can moved away from positions P1. The user is thus able to adjust the resilient body 15 to avoid having the same parts thereof being continuously exposed to wear and strain at the first and second mounting members 21,22, thereby helping to increase the longevity of the body 15.

In an alternate embodiment, the resilient body 15 is not a loop. In such an embodiment, the resilient body 15 is two or more independent resilient segments extending between the first and second mounting members 21,22, which define the first and second portions 17A,17B, and whose length can be adjusted to avoid having the same part thereof being continuously exposed to wear and strain. In another embodiment, the first and second portions 17A,17B are displaced independently of each other, and not displaced simultaneously.

Referring to FIG. 8, there is disclosed a method of adjusting a resistance-generating device 10, such as by adjusting the resilient body 15. The method includes displacing parts of the device 10, such as parts of the body 15, which are positioned at opposed ends 16 of the resistance-generating device to another position in which the parts of the resistance-generating device are positioned between the opposed ends 16.

Referring to FIG. 1, there is also disclosed a method of generating resistance. The method includes connecting one end 16 of a first resilient body 15 to the stationary first structure 11. The method includes connecting another end 16 of the first resilient body 16 to the displaceable second structure 12. The method includes connecting one end 16 of at least another resilient body 15 to one of the ends 16 of the first resilient body 15. The method includes displacing the second structure 12 relative to the first structure 11 to elastically deform at least the first resilient body 15 to generate resistance.

It can thus be appreciated that the device 10 disclosed herein allows the user to easily modify the resistance desired for training. For example, if the user wants to experience more resistance, such as for weight training, she may simply combine the devices 10 together, and mount the set 40 of devices 10 to the first and second structures 11,12. Similarly, if the user wants to experience less resistance, such as for cardiovascular training, she may simply detach or decouple one or more of the devices 10 from the set 40, or change the devices 10 for one offering less resistance.

This compares favourably to certain prior art exercise machines, which require that free weights be added to a support. Such a technique for modifying the resistance is cumbersome because it requires manipulating relatively heavy weights. Furthermore, manipulating relatively heavy weights increases the risk that a weight might be dropped and cause injury, or impact someone while it is being displaced. There is also a limit to how much additional weight the machine can support before experiencing structural stress and/or failure. Furthermore, such a technique for modifying the resistance requires that the user have different free weights available during training. Maintaining a suitable amount of free weights available for training is cumbersome, expensive, and unlikely to occur.

In contrast, the device 10 disclosed herein allows resistance to be rapidly scaled up or down, without the above-described inconveniences and potential dangers associated with free weights.

The device 10 therefore facilitates cardiovascular and/or weight-training exercises by allowing the user to easily increase the resistance by adding more of the relatively light-weight and easily-stored devices 10. The device 10 are both space and weight efficient, and easy to transport.

The descriptors "first" and "second" are used herein merely to distinguish components from one another. It will be appreciated that the descriptors can be reversed, and that the components described as "first" can also be described as "second".

The above description is meant to be exemplary only, and one skilled in the art will recognize that changes may be made to the embodiments described without departing from the scope of the invention disclosed. Other modifications which fall within the scope of the present invention will be apparent to those skilled in the art, in light of a review of this disclosure, and such modifications are intended to fall within the appended claims.

The invention claimed is:

1. A resistance-generating device, comprising: a resilient body extending between opposed ends, a first mounting member attached to the resilient body at one of the ends and a second mounting member attached to the other end of the resilient body, the resilient body having a first portion extending between the first and second mounting members and a second portion extending between the first and second mounting members, the first portion being spaced apart from the second portion, the first and second mounting members being made of an inelastic material, at least one of the first and second mounting members being removably mountable to a corresponding one of the first and second mounting members of another resistance-generating device, the first mounting member being removably mountable to a first structure and the second mounting member being removably mountable to a second structure being displaceable relative to the first structure, the resilient body generating resistance upon the first and second portions being elastically deformed by displacement of the second mounting member mounted to the second structure relative to the first mounting member mounted to the first structure.

2. The resistance-generating device of claim 1, wherein the resilient body is a loop extending between opposed loop ends, the first mounting member attached to the loop at one of the loop ends and the second mounting member attached to the other loop end of the loop, the loop defining the first and second portions between the loop ends.

3. The resistance-generating device of claim 2, wherein the loop is displaceable relative to the first and second mounting members.

4. The resistance-generating device of claim 2, wherein each of the first and second mounting members include a rotatable support, the loop mounted to the rotatable supports at each of the loop ends and being displaceable about the rotatable supports relative to the first and second mounting members.

5. The resistance-generating device of claim 1, wherein the first and second portions of the resilient body are displaceable relative to the first and second mounting members.

6. The resistance-generating device of claim 5, wherein each of the first and second mounting members include a rotatable support, the first and second portions of the resilient body mounted to the rotatable supports, the rotatable supports rotating upon the first and second portions of the resilient body displacing relative to the first and second mounting members.

7. The resistance-generating device of claim 6, wherein each of the first and second mounting members include an end cap defining a cavity, the rotatable support including a shaft disposed in the cavity and mounted to the end cap, the shaft defining a shaft axis and being rotatable about the shaft axis upon the first and second portions of the resilient body displacing relative to the first and second mounting members.

8. The resistance-generating device of claim 1, wherein the first and second portions of the resilient body are displaceable relative to the first and second mounting members, the first portion being displaceable toward the first mounting member such that the second portion is simultaneously displaceable toward the second mounting member, and the first portion being displaceable toward the second mounting member such that the second portion is simultaneously displaceable toward the first mounting member.

9. The resistance-generating device of claim 1, wherein at least one of the first mounting member, the second mounting member, and the resilient body have a visual indicia indicative of a resistance of the device.

10. A set of the resistance-generating device of claim 1, wherein at least one of the first and second mounting members of each resistance-generating device are removably mountable to the corresponding first and second mounting members of another resistance-generating device to increase a resistance provided by the set.

11. A method of adjusting a resistance-generating device, comprising: displacing parts of the resistance-generating device positioned at opposed ends of the resistance-generating device to another position in which the parts of the resistance-generating device are positioned between the opposed ends.

12. The method of claim 11, wherein displacing the parts of the resistance-generating device includes displacing some of the resistance-generating device toward one of the opposed ends in a first direction while simultaneously displacing a rest of the resistance-generating device in a second direction opposite to the first direction toward the other opposed end.

13. The method of claim 11, wherein displacing the parts of the resistance-generating device includes displacing the parts of the resistance-generating device in a looping motion.

14. An exercise apparatus, comprising:

a first structure spaced apart from a second structure, the second structure being displaceable relative to the first structure; and one or more resistance-generating devices having a resilient body extending between opposed ends, a first mounting member attached to the resilient body at one of the ends and a second mounting member attached to the other end of the resilient body, the resilient body having a first portion extending between the first and second mounting members and a second portion extending between the first and second mounting members, the first portion being spaced apart from the second portion, the first and second mounting members being made of an inelastic material, at least one of the first and second mounting members being removably mountable to a corresponding one of the first and second mounting members of another resistance-generating device, the first mounting member being removably mountable to the first structure and the second mounting member being removably mountable to the second structure, the resilient body generating resistance upon the first and second portions being elastically deformed by displacement of the second mounting member mounted to the second structure relative to the first mounting member mounted to the first structure.

15. The exercise apparatus of claim 14, wherein the resilient body is a loop extending between opposed loop ends, the first mounting member attached to the loop at one of the loop ends and the second mounting member attached to the other loop end of the loop, the loop defining the first and second portions between the loop ends.

16. The exercise apparatus of claim 15, wherein the loop is displaceable relative to the first and second mounting members.

17. The exercise apparatus of claim 15, wherein each of the first and second mounting members include a rotatable support, the loop mounted to the rotatable supports at each of the loop ends and being displaceable about the rotatable supports relative to the first and second mounting members.

18. The exercise apparatus of claim 14, wherein the first and second portions of the resilient body are displaceable relative to the first and second mounting members.

19. The exercise apparatus of claim 18, wherein each of the first and second mounting members include a rotatable support, the first and second portions of the resilient body mounted to the rotatable supports, the rotatable supports rotating upon the first and second portions of the resilient body displacing relative to the first and second mounting members.

20. The exercise apparatus of claim 19, wherein each of the first and second mounting members include an end cap defining a cavity, the rotatable support including a shaft disposed in the cavity and mounted to the end cap, the shaft defining a shaft axis and being rotatable about the shaft axis upon the first and second portions of the resilient body displacing relative to the first and second mounting members.

21. The exercise apparatus of claim 14, wherein the first and second portions of the resilient body are displaceable relative to the first and second mounting members, the first portion being displaceable toward the first mounting member such that the second portion is simultaneously displaceable toward the second mounting member, and the first portion being displaceable toward the second mounting member such that the second portion is simultaneously displaceable toward the first mounting member.

22. The exercise apparatus of claim 14, wherein the one or more resistance-generating devices includes a set of resistance-generating devices, at least one of the first and second mounting members of each resistance-generating device are removably mountable to the corresponding first and second mounting members of another resistance-generating device to increase a resistance provided by the set.

* * * * *